United States Patent [19]

Cotta

[11] Patent Number: 4,646,852

[45] Date of Patent: Mar. 3, 1987

[54] PNEUMATIC MALLET

[75] Inventor: Gilbert A. Cotta, Cincinnati, Ohio

[73] Assignee: Senco Products, Inc., Cincinnati, Ohio

[21] Appl. No.: 701,918

[22] Filed: Feb. 14, 1985

[51] Int. Cl.[4] ..... B25D 17/06

[52] U.S. Cl. ..... 173/128; 173/131; 173/29; 173/133

[58] Field of Search ..... 173/29, 48, 128, 129, 173/131, 132, 133, 15, 126, 122; 227/120, 147; 279/19, 19.5, 99

[56] References Cited

U.S. PATENT DOCUMENTS

| | | | |
|---|---|---|---|
| 2,903,932 | 9/1959 | McGonagill | 173/126 |
| 3,278,104 | 10/1966 | Becht et al. | 227/130 |
| 3,602,419 | 8/1971 | Doberne | 227/147 |
| 3,747,692 | 7/1973 | Davidson | 173/132 |
| 3,827,509 | 8/1974 | Larson | 173/128 |
| 3,854,536 | 12/1974 | Hallock, Jr. | 173/131 |
| 3,921,729 | 11/1975 | Schmuck | 173/14 |
| 3,926,266 | 12/1975 | Dorgnon | 173/110 |
| 4,064,949 | 12/1977 | Chromy | 173/14 |

*Primary Examiner*—Donald R. Schran
*Assistant Examiner*—James L. Wolfe
*Attorney, Agent, or Firm*—Frost & Jacobs

[57] ABSTRACT

A hand tool in the form of a pneumatically actuated mallet. The tool comprises a conventional pneumatic motor of the type employed in pneumatic fastener driving tools, including a tool body having a main cylinder, a piston/driver assembly, trigger-actuated control valve means, and means for connection to a source of air under pressure. A guide body is affixed to the tool body beneath the main cylinder and has a longitudinal bore to slidably guide the driver. A housing is supported by the free end of the guide body and comprises a closed first end adjacent the guide body with a perforation for passage of the driver therethrough, a peripheral wall and an open second end. A mallet is provided having a body portion and a slightly larger head portion with a shoulder formed therebetween. A retainer is affixed to the housing wall partially closing the second end of the housing. The mallet head portion is reciprocally mounted in the housing with its body portion extending through an opening in the retainer. A spring biases the mallet head shoulder into abutment with the retainer, in which position the mallet head is just out of reach of the driver. The mallet body mounts a nose piece. When the nose piece is pressed against a work piece and the trigger is actuated, the piston/driver assembly accelerates forwardly and impacts the mallet head, generating a push force in the mallet and its nose piece.

24 Claims, 5 Drawing Figures

PNEUMATIC MALLET

TECHNICAL FIELD

The invention relates to a hand tool, and more paticularly to a pneumatically actuated mallet.

BACKGROUND ART

The present invention relates to the development of a hand-held, pneumatically actuated mallet. Prior art workers have heretofore devised various types of electro-pneumatic hammers. Such hand-held electro-pneumatic hammers are taught, for example, in U.S. Pat. Nos. 3,921,729; 3,926,266 and 4,064,949. These tools, however, are completely different in concept and operation from the pneumatic mallet of the present invention. The typical electro-pneumatic hammer provides an air cushion within the bore of a cylinder between a driving piston and a striking piston. The driving piston is operated by an electric motor and a crank. The striking piston operates on an appropriate tool removably mounted in the forward end of the electro-pneumatic hammer.

Prior art workers have also devised numerous types of pneumatic fastener driving tools. Such tools are used to drive headed or headless nails, staples and other appropriate types of fasteners.

As is well known in the art, pneumatic fastener driving tools basically comprise a housing having a handle portion. The housing contains a main cylinder having a piston/driver assembly. The housing also contains control valve means for actuating the piston/driver assembly in the main cylinder. The control valve means, in turn, is operated by a manual trigger generally located near the juncture of the housing and its handle portion. The pneumatic fastener driving tool additionally has a guide body mounted on the housing beneath the main cylinder. The guide body provides a drive track for the driver and the fasteners to be driven. The fasteners are located in a magazine communicating with the guide body and its drive track. In the most usual structure, the housing handle portion is hollow and provides a reservoir for air under pressure together with means to connect the reservoir to a source of air under pressure.

The more modern examples of such pneumatic fastener driving tools are equipped with a mode selector valve which enables the fastener driving tool to operate in a "single-fire" or an "auto-fire" mode of operation. In the single-fire mode of operation, a fastener is driven upon each actuation of the manual trigger. In an auto-fire mode of operation, fasteners are driven continuously, so long as the trigger is held in its actuated position.

An exemplary, but non-limiting, embodiment of such a pneumatic fastener driving tool is set forth in U.S. Pat. No. 3,278,104. For purposes of description, the teachings of this patent are herein incorporated by reference. In pneumatic fastener driving tools of the type just described, the housing and its handle portion, the main cylinder, the piston/driver assembly, the control valve means, the manual trigger, the means for connection to a source of air under pressure and the firing mode selector valve (if present) may be considered a pneumatic motor. It is this type of pneumatic motor which is utilized in the mallet of the present invention.

The present invention is based upon the discovery that a hand-held tool in the form of a pneumatically actuated mallet can be provided, utilizing such a pneumatic motor provided with a modified guide body and mallet assembly. The mallet tool of the present invention can be manufactured as such, or an existing pneumatic fastener driving tool can be converted to a pneumatic mallet, as will be described hereinafter. The mallet of the present invention is simple in construction and operation, and limits human fatigue by eliminating the necessity for repeated swinging of the operator's arm. The mallet also resolves ergonomic problems related to Carpal Tunnel Syndrome, an occupational disorder frequently resulting from constant swinging of the arm and wrist and constituting inflammation, chronic pain and sometimes permanent injury to the synovial sheath protecting the tendons of the wrist and the median nerve passing through the wrist.

DISCLOSURE OF THE INVENTION

According to the invention there is provided a hand tool in the form of a pneumatically actuated mallet. The tool comprises a conventional pneumatic motor of the like, including a tool housing having a main cylinder, a piston/driver assembly, trigger actuated control valve means and means for connection to a source of air under pressure.

A guide body is affixed to the tool housing beneath the main cylinder and has a longitudinal bore to slidably receive and guide the driver of the piston/driver assembly. A housing is supported by the free end of the guide body. The housing comprises a closed first end adjacent the guide body free end, having a perforation coaxial with the guide body bore to permit the passage of the driver therethrough. The housing additionally comprises a peripheral wall extending from the first closed end and terminating in a second open end.

A mallet is provided having a body portion and a head portion of slightly larger dimensions, so as to form a shoulder therebetween. A retainer is affixed to the housing wall, having an inturned flange partially closing the open second end of the housing. The mallet head portion is reciprocally mounted in the housing with its body portion extending through the opening defined by the flange of the retainer. The end surface of the mallet head may be provided with an impact member embedded therein and adapted to cooperate with the driver. A spring biases the mallet head away from the closed end of the housing so that the mallet shoulder normally abuts the retainer. In this position, the mallet head is just out of reach of the driver, as will be explained hereinafter.

The free end of the mallet body mounts a nose piece. It is within the scope of the invention to provide various types of nose pieces, interchangeably mountable on the free end of the mallet body, depending upon the intended use of the tool. When the nose piece of the tool is pressed against a workpiece and the tool trigger is actuated, the piston/driver assembly accelerates and impacts the mallet head, generating a push force in the mallet and its nose piece. If the pneumatic motor is provided with a firing mode selector valve of the type well known in the art, the mallet may be used in either a single blow or a multiple-blow mode.

DETAILED DESCRIPTION OF THE INVENTION

Figure 1:
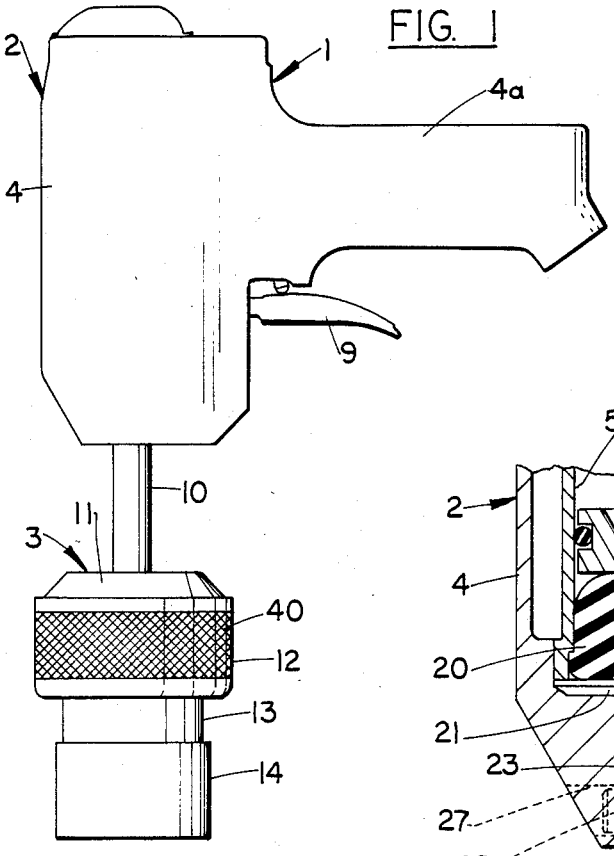
FIG. 1 is a side elevational view of the mallet tool of the present invention.

In all of the figures like parts have been given like index numerals. Reference is first made to FIG. 1 wherein the overall mallet tool of the present invention is shown and is generally indicated at 1. The mallet tool comprises a pneumatic motor generally indicated at 2 and a guide body/mallet assembly generally indicated at 3.

The pneumatic motor 2 is of the type used with pneumatic fastener driving tools. The precise nature and inner workings of the pneumatic motor do not constitute a limitation of the present invention. Prior art workers have devised many such pneumatic motors suitable for use in the present invention. For purposes of an exemplary showing, the pneumatic motor 2 may be considered to be generally like that taught in the above mentioned U.S. Pat. No. 3,278,104. The pneumatic motor 2 has a housing 4 with a handle portion 4*a*. The housing 4 contains a main cylinder such as the main cylinder 5 shown in FIG. 2. The main cylinder, itself, contains a piston/driver assembly, an example of which is shown generally at 6 in FIG. 2. The piston/driver assembly comprises a piston 7 and an elongated driver 8, affixed to the piston 7.

Movement of the piston/driver assembly 6 is controlled by control valve means (not shown). The nature of the control valve means does not constitute a limitation of the present invention, prior art workers having devised many types of control valve means, which are well known to those skilled in the art. The control valve means is, in turn, actuated by a manual trigger 9 most usually pivotally affixed to the housing 4 adjacent the juncture of housing 4 and handle 4*a*. In most embodiments of pneumatic motors 2, the handle portion 4*a* is hollow and provides a reservoir for air under pressure. The handle 4a will also be provided with means (not shown) whereby the reservoir may be connected to a hose leading to a source of air under pressure.

Figure 2:
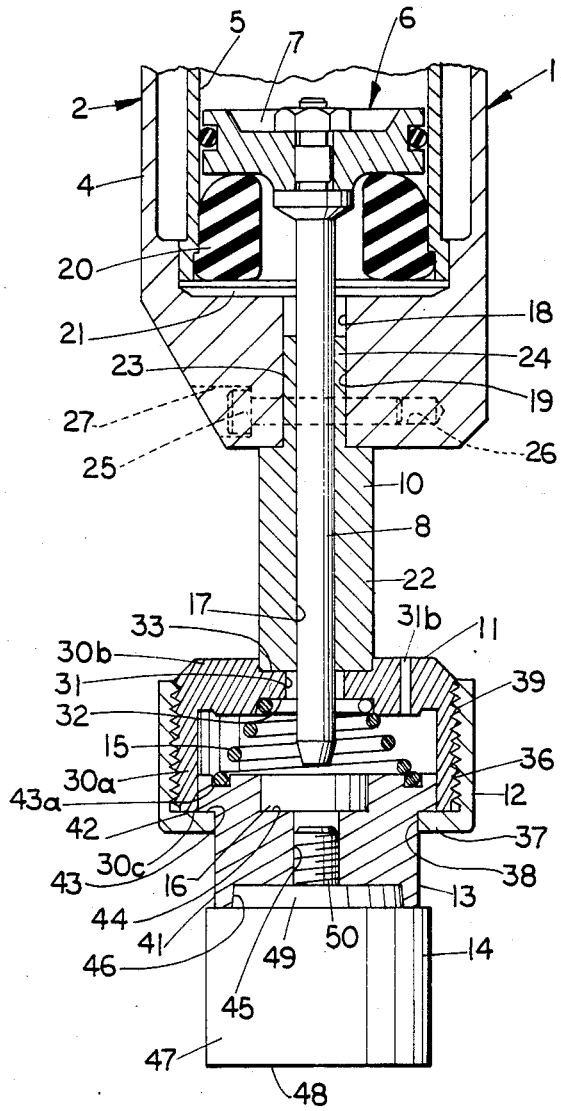
FIG. 2 is an enlarged, fragmentary, cross sectional view of a portion of the pneumatic motor, and the guide body/mallet assembly.
Figure 3:
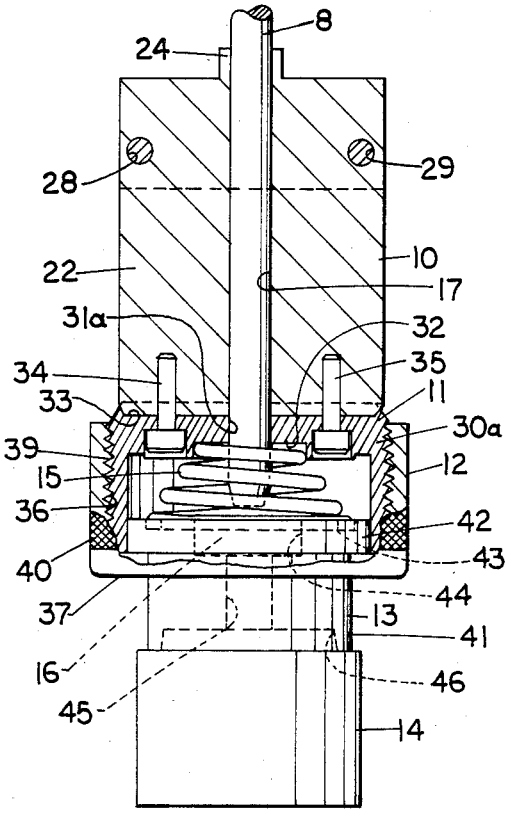
FIG. 3 is an elevational view, partly in cross section, of the guide body/mallet assembly, fragmentarily illustrating the driver.
Figure 4:
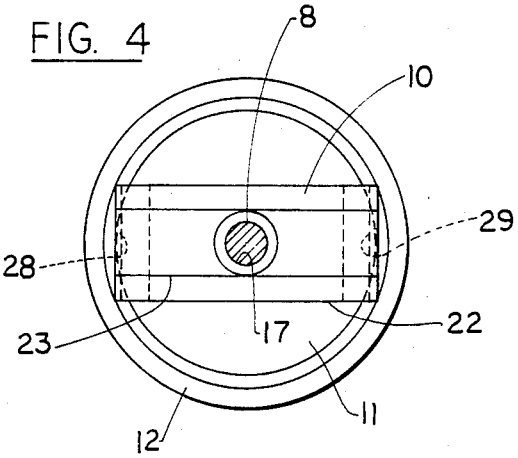
FIG. 4 is a plan view of the structure of FIG. 3.

The guide body/mallet assembly 3 of the present invention is best shown in FIGS. 2, 3 and 4. The basic parts of the assembly 3 comprise a guide body 10, a housing 11, a retainer 12, a mallet 13 and a nose piece 14. The structure further includes a conical biasing spring 15. The mallet may optionally be provided with a hardened impact-receiving member 16, as will be described hereinafter. The guide body 10 is provided with a longitudinal bore 17 adapted to slidably receive and guide the driver 8. The exterior configuration of guide body 10 will depend upon the nature of the pneumatic motor 2 and the manner in which the guide body 10 is affixed to the pneumatic motor 2.

In the exemplary embodiment illustrated, the housing 4 of pneumatic motor 2 has a bore 18 leading to the piston 5 and adapted to accept the driver 8 with clearance. The bore 18 is intersected by a transverse slot 19. The bottom of cylinder 5 is provided with a conventional resilient bumper 20 adapted to absorb the remaining energy at the end of the down stroke of the piston/driver assembly 6. At the bottom of the cylinder 5 there is a seal 21 which sealingly engages the driver 8.

The guide body 10, in the exemplary embodiment shown, has a main body portion 22 and an upper body portion 23 of lesser thickness. The upper body portion 23 terminates in an annular portion 24. The annular portion 24 is received within the bore 18 of pneumatic motor housing 4. In similar fashion, the upper body portion 23 of the guide body 10 is received in the transverse slot 19 of the pneumatic motor housing 4.

In the exemplary embodiment illustrated, the guide body 10 is affixed to the pneumatic motor housing 4 by a pair of machine screws, one of which is shown at 25 in FIG. 2. To this end, the pneumatic motor housing 4 is provided with a pair of transverse threaded perforations, one of which is shown at 26 in FIG. 2. The perforation 6 has an enlarged portion 27 to enable countersinking of the head of machine screw 25. The upper body portion 23 of guide body 10 has a pair of perforations 28 and 29. The perforation 28 is coaxial with the pneumatic motor housing perforation 26 when the guide body 10 is mounted in place on the pneumatic motor housing 4, and the machine screw 25 passes through the perforation 28. The perforation 29 will be similarly coaxial with the second transverse perforation (not shown) in the pneumatic motor housing 4 and will accept a machine screw (not shown) therethrough.

While the guide body 10 is illustrated as being bolted to the pneumatic motor housing 4, it will be understood by those skilled in the art that other attachment means may be used, depending upon the nature of the housing 4 of the pneumatic motor and the nature of the guide body. The guide body 10 is preferably made of steel, but may be made of other metallic materials such as aluminum, or plastic material, or the like.

As viewed in the figures, the housing 11 comprises a cylindrical member having an annular wall 30*a* a closed upper end 30*b* and an open lower end 30*c*. The closed upper end 30*b* has a perforation 31*a* formed therein, adapted to permit passage of the driver 8 therethrough with clearance, and also contains a bore 31*b* adapted to vent the inside of housing 11 to atmosphere. On the inside surface of the housing upper end 30*b*, an annular notch 32 surrounds the perforation 31*a*. The purpose of the annular notch 32 will be apparent hereinafter.

As is most clearly shown in FIGS. 2 and 3, the upper surface of the closed end 30*b* of housing 11 has a transverse notch 33 formed therein. The notch 33 is adapted to receive the free end of guide body 10, with the guide body bore 17 being coaxial with the perforation 31*a* of housing 11. The housing 11 is affixed to the guide body 10 by a pair of machine screws 34 and 35. Again, the housing 11 may be made of steel, aluminum, or plastic material.

While the guide body 10 and housing 11 are shown as two separate pieces joined together by machine screws 34 and 35, it will be understood by one skilled in the art that the guide body 10 and the housing 11 could constitute an integral, one-piece casting, or the like. In the embodiment shown, the exterior surface of housing 11 is illustrated as being threaded as at 36.

The retainer 12 is a cylindrical or annular rim-like member, having at its bottom edge (as viewed in FIGS. 2 and 3) an inturned, annular flange 37, which partially closes the open end 30*c* of housing 11 and which defines a circular opening 38. The retainer 12 may also be made of steel, aluminum, plastic, or the like. The inside surface of retainer 12 is threaded, as at 39, and therefore is threadedly engageable on housing 11, as shown. Preferably, the outside surface of retainer 12 is knurled, as shown at 40 in FIGS. 1 and 3.

The mallet 13 comprises a cylindrical body 41 having a cylindrical head 42 of slightly larger diameter so as to form a shoulder 43 therebetween. The body portion 41 of mallet 13 is of a diameter such that it is slidable within the circular opening 38 defined by retainer flange 37. The head 42 of mallet 13 is of a larger diameter than retainer opening 38, the diameter being such that the head 42 is slidable within housing 11. The upper surface of mallet head 42 has an annular groove **43*a* formed therein. The groove 43*a* serves as a seat for the larger diameter end of the conical compression spring 15. The annular notch 32 in the inside surface of housing upper end 30*b* serves as a seat for the small diameter end of compression spring 15, as shown in FIGS. 2 and 3. Compression spring 15 biases mallet 13 to its lowermost position as illustrated in FIGS. 2 and 3, with the mallet shoulder 43 in abutment with the inside surface of retainer flange 37**.

The mallet 13 may be made of steel, aluminum or an appropriate plastic material. It is within the scope of the present invention to provide the upper surface of mallet head 42 with a circular depression 44 for the receipt of a hardened steel impact-receiving member 16, adapted to cooperate with the free end of driver 8. The impact-receiving member 16 may be affixed in the circular depression 44 in any suitable manner, including a press fit.

The mallet 13 has an axial bore 45. The axial bore 45 may communicate with the circular depression 44 at one end and with a larger circular depression 46 at the other. The bore 45 is internally threaded.

The guide body/mallet assembly 3 is completed by the nose piece 14. In the embodiment shown, the nose piece 14 comprises a cylindrical body 47 terminating in a working end 48. The end of the nose piece, opposite the working end 48, has a portion 49 of lesser diameter, adapted to be just nicely received in the circular depression 46 of mallet 13. Finally, the nose piece is provided with a threaded stem 50, adapted to be threadedly engaged in the mallet bore 45.

It is apparent from the above description that the nose piece is readily replaceable and, in fact, a plurality of interchangeable nose pieces can be provided, made of different material, depending upon the nature of the work to be done. For example, the nose piece 14 can be made of rolled leather, rubber, metal or the like. Nose pieces of different configuration can also be provided. To this end, reference is made to FIG. 5.

Figure 5:
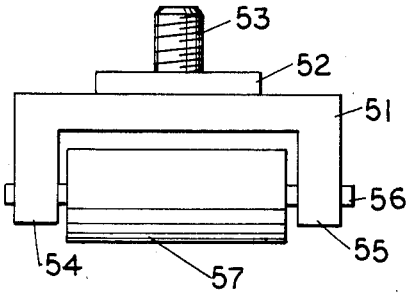
FIG. 5 is an elevational view of an exemplary, alternative nose piece.

In FIG. 5 a roller-type nose piece is shown comprising a bracket 51 having an upper circular portion 52 equivalent to the portion 49 in FIG. 2 and a threaded stem 53, equivalent to threaded stem 50 of FIG. 2. The bracket 51 has a pair of parallel-spaced legs 54 and 55 supporting a shaft 56. The shaft 56, in turn, supports a roller 57. As in the case of body 47 of nose piece 14 of FIG. 2, the roller 57 of FIG. 5 can be made of any appropriate material, depending upon the job to be done, and including metal, plastic, rubber, or the like. The roll 57 may be contoured, if desired.

It will be apparent that the nose piece of FIG. 5 can be mounted on mallet 13 in the same manner described with respect to nose piece 14 of FIG. 2. The roller nose piece of FIG. 5 has many uses as, for example, in the mounting of a gasket in a gasket receiving groove. The roller enables the tool to be moved along a straight or curved line during use of the tool.

The tool having been described in detail, the manner of its use may now be described. It is important to note, as is shown in FIG. 2. that when the tool is at rest, the conical compression spring 15 maintains the mallet head shoulder 43 in abutment with the inside surface of the retainer flange 37. When the mallet 13 is in this position, it is out of reach of the driver, even when the driver is in its actuated position, as shown in FIG. 2. The space between the free end of driver 8 and the mallet 13 or its insert 16) can have any appropriate dimension. A spacing of about 1/16 inch has been found adequate. This assures that if the pneumatic motor 2 is inadvertently fired or actuated when the mallet nose piece 14 is not pressed against a work piece, the mallet 13 and its nose piece will not be actuated by the driver 8.

When the mallet tool 1 of the present invention is properly used, the mallet nose 14 is pressed against the element intended to receive a blow or blows. This causes the mallet 13 and its head 42 to shift within housing 11 toward the guide body 10. When trigger 9 is actuated, the driver/piston assembly 6 accelerates toward the mallet head 42 and its hardened insert 16 (if present). The free end of driver 8 impacts the mallet head 42 (or its insert 16) and a push force is generated in the mallet 13 and its nose piece 14, against the element contacted thereby. The magnitude of the push force generated by actuation of trigger 9 of pneumatic motor 2 is dependent upon the operating pressure of the tool 1 and the hardness of the nose piece 14. It has been found that the best operating range of the tool 1 is achieved when the air pressure is set between from about 70 to about 100 psi. Since nose pieces 14, ranging from soft to extra hard, can be interchangeably mounted on mallet 13, the resulting push force, over the above noted air pressure range, will range from about 70 to about 2000 pounds.

Under the circumstances just outlined, the mallet nose piece 14 will administer a blow or push force with each actuation of trigger 9. If the pneumatic motor 2 is provided with an auto-fire selector valve, well known in the art, and if the selector valve is set for auto-fire, then the mallet nose piece will administer a continuous series of blows for as long as trigger 9 is held in its actuated position, which is useful in association with the roller of FIG. 5.

Modifications may be made in the invention without departing from the spirit of it. For example, in the embodiment described in FIGS. 1 through 4, the housing 11, retainer 12, and mallet 13 are shown as being of circular transverse cross section. It will be understood that these elements could have any appropriate transverse cross section including square, rectangular or the like. Under these circumstances, the nature and operation of these elements would be identical to that described above, with the exception that the retainer 12 would have to be affixed to the housing 11 by some other means such as set screws or the like.

It will further be understood by one skilled in the art that the guide body/mallet assembly 3 of the present invention could be manufactured and sold as an accessory to convert an existing pneumatic fastener driving tool to the pneumatic mallet of the present invention. It would only be necessary to properly dimension the parts and to configure the guide body 10 for proper attachment to the fastener driving tool, replacing the existing guide body and magazine.

In the above description, words such as "upper", "lower", "top", "bottom", "lowermost", and the like are used for purposes of clarity in conjunction with the figures. One skilled in the art will understand that during use the mallet tool can assume any desired orientation.

What is claimed is:

1. A pneumatic mallet comprising a conventional pneumatic motor and a guide body and mallet assembly, said pneumatic motor being of the type having a housing with a handle portion, said pneumatic motor housing containing a main cylinder with piston and driver assembly therein, a trigger actuated control valve means for said main cylinder and means for connection to a source of air under pressure, said guide body and mallet assembly comprising a guide body affixed to said pneumatic motor housing beneath said main cylinder and having a longitudinal bore to slidably receive and guide said driver of said piston and driver assembly, a mallet housing supported by the free end of said guide body, a mallet comprising a body with a head portion at one end and a free end, said mallet head portion being captively mounted in said mallet housing and said mallet body extending beyond said mallet housing, said mallet being shiftable between a normal position wherein said head portion is out of reach of said driver and a working position wherein said head portion is contactable by said driver, and means to bias said mallet to said normal position, whereby when said mallet free end is pressed against a work piece and said mallet is shifted to said working position and said trigger is actuated, said piston and driver assembly will accelerate toward and impact said mallet head generating a push force in said mallet against said work piece.

2. The pneumatic mallet of claim 1 wherein said mallet housing comprises a peripheral wall, a substantially closed upper end adjacent the guide body having a perforation coaxial with said guide body bore for passage of said driver therethrough and an open second end, said mallet head portion being of greater dimensions than said mallet body portion forming a shoulder therebetween, a retainer affixed to said mallet housing and having an inturned flange partially closing said open second end of said mallet housing and defining an opening through which said mallet body portion extends with a sliding fit, said mallet shoulder abutting said retainer flange when said mallet is in said normal position.

3. The pneumatic mallet claimed in claim 2 wherein said means biasing said mallet to its normal position comprises a compression spring having a first end abutting said closed end of said mallet housing and a second end abutting said mallet head portion.

4. The pneumatic mallet claimed in claim 2 including a hardened metallic impact-receiving member embedded in said mallet head portion to cooperate with said driver.

5. The pneumatic mallet of claim 2 including a conventional auto-fire selector valve in said pneumatic motor whereby said piston and driver assembly will repeatedly impact said mallet head so long as said trigger is continuously actuated.

6. The pneumatic mallet of claim 2 including a work piece-contacting nose piece mounted on said mallet free end.

7. The pneumatic mallet of claim 2 including a plurality of work piece-contacting nose pieces interchangeably mountable on said mallet free end and differing from each other at least in hardness.

8. The pneumatic mallet claimed in claim 2 wherein said mallet housing and said mallet are of circular cross section, said retainer being of annular cross section.

9. The pneumatic mallet of claim 2 wherein said guide body and said mallet housing comprise a one-piece, integral structure.

10. The pneumatic mallet of claim 1 including a conventional auto-fire selector valve in said pneumatic motor whereby said piston and driver assembly will repeatedly impact said mallet head so long as said trigger is continuously actuated.

11. The pneumatic mallet of claim 1 including a work piece-contacting nose piece mounted on said mallet free end.

12. The pneumatic mallet of claim 11 wherein said nose piece comprises a bracket and a roller supported by said bracket with its axis perpendicular to said driver.

13. The pneumatic mallet of claim 1 including a plurality of work piece-contacting nose pieces interchangeably mountable on said mallet free end and differing from each other at least in hardness.

14. In a fastener driving tool of the type comprising a conventional pneumatic motor having a housing with a handle portion and means for connecting said tool to a source of air under pressure, said pneumatic motor housing containing a main cylinder with a piston and driver assembly therein, a trigger actuated control valve means for said main cylinder and means adapted to normally attach a guide member said magazine assembly, a guide body and mallet attachment attached to said means and being affixed to said pneumatic motor housing beneath said main cylinder, and having a longitudinal bore to slidably receive and guide said driver of said piston and driver assembly, a mallet housing supported by the free end of said guide body, a mallet comprising a body with a head portion at one end and a free end, said mallet head portion being captively mounted in said mallet housing and said body extending beyond said mallet housing, said mallet being shiftable between a normal position wherein said head portion is out of reach of said driver and a working position wherin said head portion is contactable by said driver, and means to bias said mallet to said normal position, such that when said mallet free end is pressed against a work piece and said mallet is shifted to said working position and said trigger is actuated, said piston and driver assembly will accelerate toward and impact said mallet head generating a push force in said mallet against said workpiece.

15. The guide body and mallet attachment of claim 14 including a work piece-contacting nose piece mounted on said mallet free end.

16. The guide body/mallet attachment of claim 15 wherein said nose piece comprises a bracket and a roller supported by said bracket with its axis perpendicular to said driver.

17. The guide body and mallet attachment of claim 14 including a plurality of work piece-contacting nose pieces interchangeably mountable on said mallet free end and differing from each other at least in hardness.

18. The guide body and mallet attachment of claim 14 wherein said mallet housing comprises a peripheral wall, a substantially closed upper end adjacent the guide body having a perforation coaxial with said guide body bore for passage of said driver therethrough and an open second end, said mallet head portion being of greater dimensions than said mallet body portion forming a shoulder therebetween, a retainer affixed to said mallet housing and having an inturned flange partially closing said open second end of said mallet housing and defining an opening through which said mallet body portion extends with a sliding fit, said mallet shoulder abutting said retainer flange when said mallet is in said normal position.

19. The guide body and mallet attachment claimed in claim 18 wherein said means biasing said mallet to its normal position comprises a compression spring having a first end abutting said closed end of said mallet housing and a second end abutting said mallet head portion.

20. The guide body and mallet attachment claimed in claim 18 including a hardened metallic impact-receiving member embedded in said mallet head portion to cooperate with said driver.

21. The guide body and mallet attachment of claim 18 including a work piece-contacting nose piece mounted on said mallet free end.

22. The guide body and mallet attachment of claim 18 including a plurality of work piece-contacting nose pieces interchangeably mountable on said mallet free end and differing from each other at least in hardness.

23. The guidy body/mallet attachmetn claimed in claim 18 wherein said housing and said mallet are of circular cross section, said retainer being of annular cross section.

24. The guide body/mallet attachment of claim 18 wherein said guide body and said housing comprise a one-piece, integral structure.

* * * * *